US007018305B2

(12) United States Patent
Sugimoto

(10) Patent No.: US 7,018,305 B2
(45) Date of Patent: Mar. 28, 2006

(54) IRON-TYPE GOLF CLUB HEAD

(75) Inventor: Yasushi Sugimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 30 days.

(21) Appl. No.: 10/267,777

(22) Filed: Oct. 10, 2002

(65) Prior Publication Data

US 2003/0078112 A1 Apr. 24, 2003

(30) Foreign Application Priority Data

Oct. 15, 2001 (JP) ..... 2001-317057

(51) Int. Cl.
*A63B 53/04* (2006.01)
*A63B 53/06* (2006.01)

(52) U.S. Cl. ..... 473/342; 473/345; 473/350

(58) Field of Classification Search ..... 473/288, 473/324, 325, 329, 330, 342, 350
See application file for complete search history.

(56) References Cited

U.S. PATENT DOCUMENTS

| | | | | |
|---|---|---|---|---|
| 1,253,700 | A * | 1/1918 | McLaughlin | 473/288 |
| 4,884,812 | A * | 12/1989 | Nagasaki et al. | 473/342 |
| 5,176,384 | A * | 1/1993 | Sata et al. | 473/329 |
| 5,242,167 | A * | 9/1993 | Antonious | 473/350 |
| 5,407,202 | A * | 4/1995 | Igarashi | 473/342 |
| 5,423,535 | A * | 6/1995 | Shaw et al. | 473/291 |
| 5,509,660 | A * | 4/1996 | Elmer | 473/288 |
| 5,816,936 | A * | 10/1998 | Aizawa et al. | 473/342 |
| 5,899,820 | A * | 5/1999 | Minematsu et al. | 473/329 |
| 6,001,032 | A * | 12/1999 | Onuki et al. | 473/342 |
| 6,220,971 | B1 * | 4/2001 | Takeda | 473/342 |
| 6,344,001 | B1 * | 2/2002 | Hamada et al. | 473/329 |
| 6,379,262 | B1 * | 4/2002 | Boone | 473/324 |
| 6,508,722 | B1 * | 1/2003 | McCabe et al. | 473/330 |
| 6,517,448 | B1 * | 2/2003 | Takeda | 473/324 |

FOREIGN PATENT DOCUMENTS

| | | |
|---|---|---|
| JP | 09-192273 A | 7/1997 |
| JP | 2001-029523 A | 2/2001 |

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

An iron-type golf clubhead comprises a face plate having a front surface forming a clubface, a back surface and a circumferential surface, and a main body provided with a face mount in which the face plate is fitted, wherein the face mount comprises a side wall for supporting the circumferential surface and a back-support wall for supporting a periphery part of the back surface, whereby the face plate is provided with an unsupported part, and the back-support wall comprises a part whose thickness (T) is less than a thickness (t1) of the periphery part supported by the back-support wall.

14 Claims, 9 Drawing Sheets

IRON-TYPE GOLF CLUB HEAD

BACKGROUND OF THE INVENTION

The present invention relates to an iron-type golf clubhead more particularly to a face mount for a face plate provided on a clubhead main body being capable of increasing flexibility of designing the position of the gravity point.

In general, in order to improve iron-type golf clubs in respect of carry, rebound performance, handling, feeling and the like, a great effort has been made in designing the clubhead to set the gravity point of the clubhead in a suitable position. Usually, as the position of the gravity point becomes lower and deeper, performance becomes better. For example, if the gravity point is lowered, backspin of the hit ball tends to decrease which may increase the carry. If the gravity point becomes deeper, sweet spot area of the clubface increases and there is a possibility of the carry and direction being improved.

SUMMARY OF THE INVENTION

It is therefore, an object of the present invention to provide an iron-type golf clubhead, in which, by reducing the weight of the face mount, flexibility of designing the gravity point of the clubhead is increased, and thereby it is possible to render the gravity point deeper and/or lower.

According to the present invention, an iron-type golf clubhead comprises a face plate having a front surface forming a clubface, a back surface and a circumferential surface, and a main body provided with a face mount in which the face plate is fitted, the face mount comprising a side wall for supporting the circumferential surface and a back-support wall for supporting a periphery part of the back surface, whereby the face plate is provided with an unsupported part, the back-support wall comprising a part whose thickness (T) is less than a thickness (t1) of the periphery part supported by the back-support wall.

DESCRIPTION OF THE PREFERRED EMBODIMENTS

Figure 1:
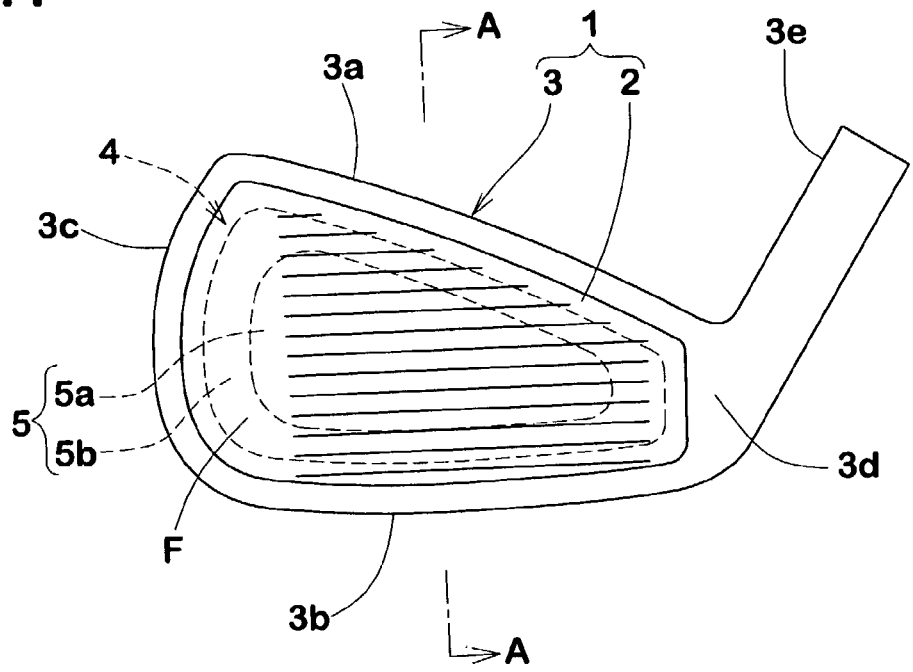
FIG. 1 is a front view of an iron-type golf clubhead according to the present invention.

Embodiments of the present invention will now be described in detail in conjunction with the accompanying drawings.

In the drawings, a golf clubhead 1 according to the present invention comprises a main body 3 and a face plate 2 attached on the front of the main body 3.

The face plate 2 has a front surface, a back surface and a circumferential surface 2*a* therebetween. The clubface F for hitting a ball is defined by a part or entirety of the front surface thereof.

The main body 3 is made of a metal material which, when compared with that of the face plate 2, has a relatively large specific gravity such as stainless steel, e.g. sus630. The main body 3 is provided on the front with a face mount 4 in which the face plate 2 is fitted.

Figure 3:
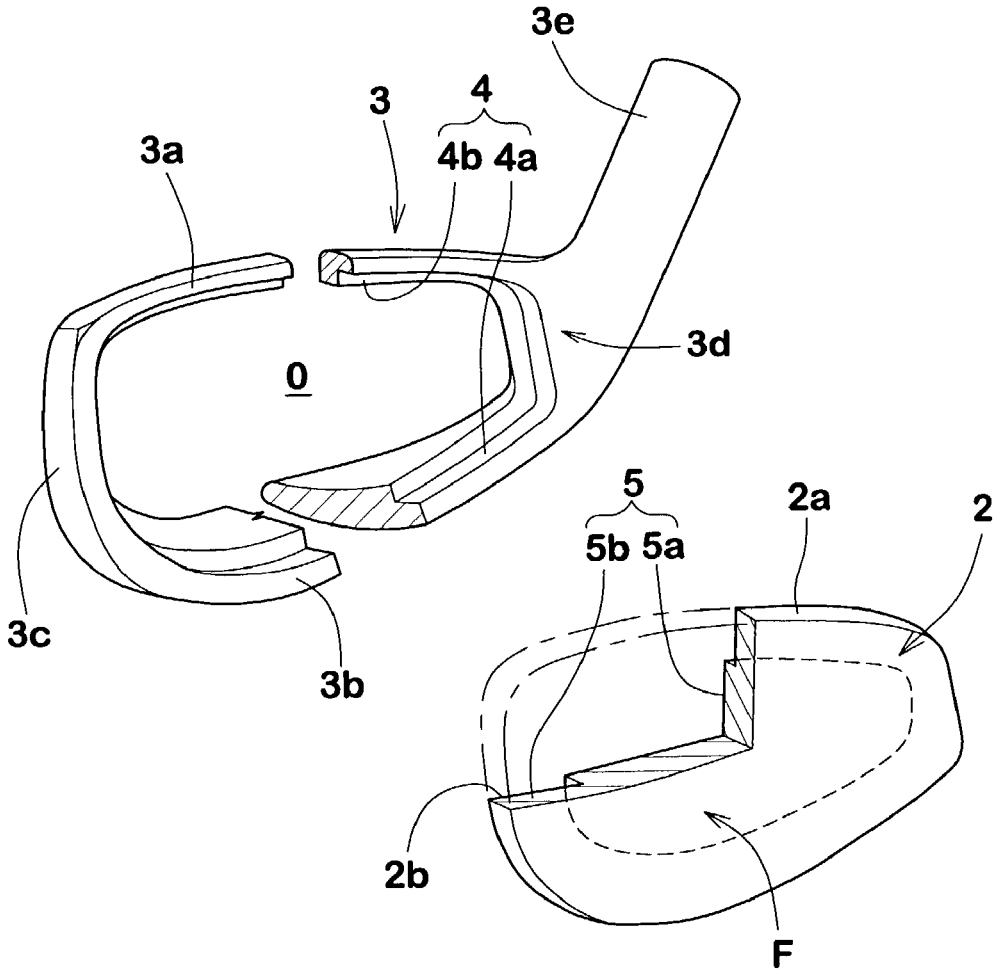
FIG. 3 is an exploded perspective of the clubhead.

The face mount 4 in this embodiment is formed by a stepped hole (O). The stepped hole (O) is as shown in FIG. 3 a through hole which also has an opening at the rear end.

The main body 3 comprises an upper rim portion 3*a*, a lower rim portion 3*b*, a toe-side rim portion 3*c* and a heel-side rim portion 3*d* surrounding the stepped hole (O). A hosel 3*e* having a hole for inserting a club shaft is formed integrally with the heel-side rim portion 3*d*. The lower rim portion 3*b* has a backward extension to form the sole of the clubhead 1.

In the front views and cross sectional views, the clubhead is set in its normal position, namely, the center line of the shaft inserting hole of the hosel 3*e* is inclined at the lie angle while keeping the center line on a vertical plane, and the clubface F forms its loft angle with respect to a horizontal plane.

The face mount 4 comprises an annularly continuously extending circumferential wall 4*a* which provides support for the circumferential surface 2*a* of the face plate 2, and an annularly continuous back-support wall 4*b* which provides support for a periphery part 2*b* of the back surface of the face plate 2.

The back-support wall 4*b* extends towards the inside of the hole (O) from the rear edge of the circumferential wall 4*a* to a height (h). Here, the height (h) is a protruding height measured perpendicularly to the circumferential wall 4*a*.

The face plate 2 is made of a different material than that of the main body 3. In this embodiment, a metal material having a smaller specific gravity than the main body 3 such as titanium alloys is used. Therefore, it becomes possible to shift the weight of the clubhead towards the periphery and/or backwards of the clubface F which may help to increase the sweet spot area. Aside from titanium alloys, various metal materials, e.g. maraging steel, aluminum alloys, amorphous alloys and the like may be also used for the face plate 2.

The front surface of the face plate 2 has a substantially flat profile at least in the corresponding part to the clubface F. It is of course possible to provide the clubface F with roughness such as face line grooves and the like in order to increase friction against a ball.

The face plate 2 is accommodated to the face mount 4, and it is fitted therein and fixed to the main body 3 by means of caulking, adhesive bonding, soldering, press fitting, welding (if possible) or the like. Therefore, the circumferential surface 2*a* of the face plate 2 is supported by the circumferential wall 4*a*, and a periphery part 2*b* of the back surface of the face plate 2 is supported by the back-support wall 4*b*.

The periphery part 2*b* supported has a substantially constant thickness t1 If the thickness t1 is too large, an unnecessary weight increases. If the thickness t1 is too small, the strength of the face plate 2 decreases in the part jointed with the main body 3 and separation or gap is liable to occur between them. Viewed in this light, the thickness t1 is set in a range of from 1.5 to 4.0 mm, preferably 1.5 to 3.0 mm, more preferably 1.5 to 2.5 mm.

If an area of the periphery part 2*b*, namely, the area which is supported by the back-support wall 4*b* is too small, it becomes difficult to obtain a sufficient fixing strength. If the supported area is too large, there is a possibility that rebound performance deteriorates. From this viewpoint, the supported area is set in a range of from 5 to 30%, preferably 10 to 20% of an apparent area of the back surface of the face plate 2 which is obtained regarding the back surface of the face plate as flat (which is thus equal to the projected area on a flat plane substantially parallel with the front surface).

As a result, the face plate 2 is provided within the supported part 2*b* with an unsupported portion 5 of which back surface does not come into contact with the back-support wall 4*b*. Such unsupported portion 5 helps to improve the rebound performance of the clubhead because the unsupported portion 5 may cause its elasticity deformation without being interrupted by the main body 3 when hitting a ball.

Figure 2:
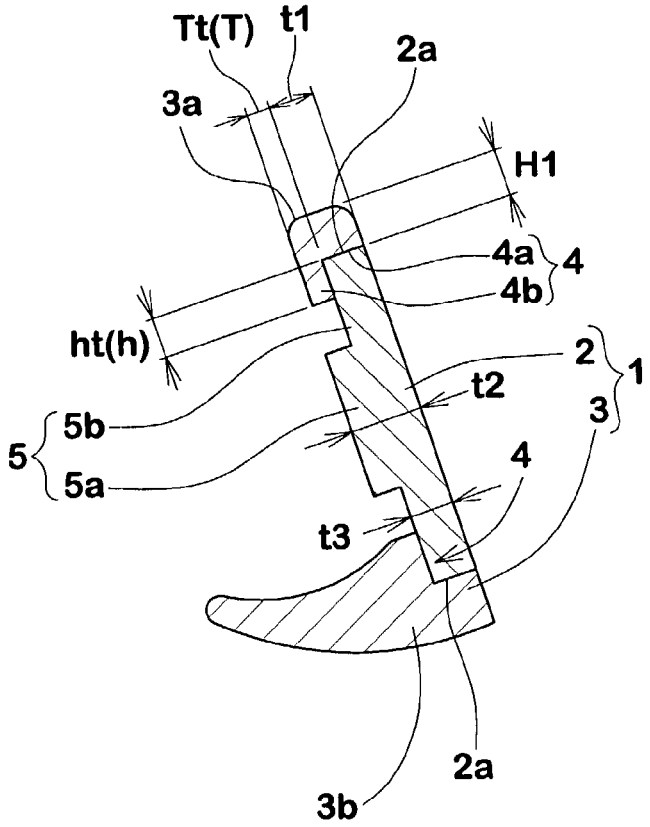
FIG. 2 is a cross sectional view taken along a line A—A in FIG. 1.

In this embodiment, as shown in FIG. 2, the unsupported portion 5 is composed of a thick part 5*a* and a surrounding thinner part 5*b*. The thick part 5*a* has a thickness t2 more than the thickness t1 of the periphery part 2*b*. The thinner part 5*b* has a thickness t3 substantially same as or not more than the thickness t1 of the periphery part 2*b*.

If the thick part 5*a* is too thick, there is a tendency to decrease carry because the rebound performance of the clubhead decreases. If too thin, the durability is liable to deteriorate. From this viewpoint, the thickness t2 of the thick part 5*a* is set in a range of from 2.0 to 6.0 mm, preferably 2.0 to 5.0 mm, more preferably 2.5 to 3.5 mm.

Figure 4:
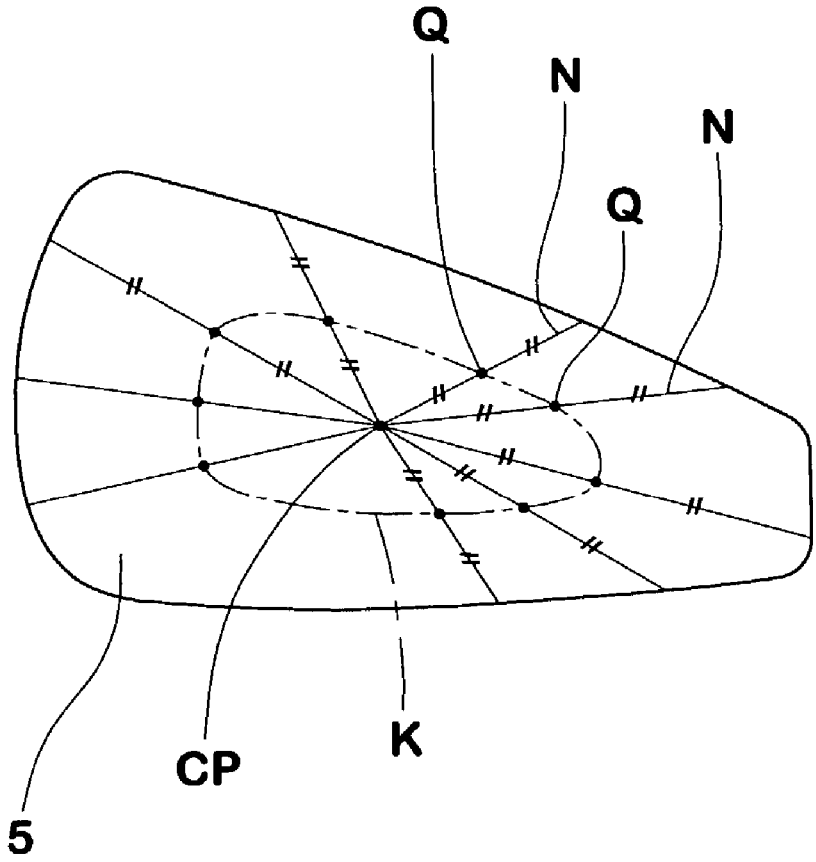
FIG. 4 is a diagram for explaining a definition of a central region of the unsupported portion.

In FIGS. 1 and 3, the thick part 5*a* is formed in a central region of the clubface F as being long from side to side in the longitudinal direction of the face plate 2. Here, the central region is, as shown in FIG. 4, defined as a region enclosed by a closed curved line K described by the middle point Q of a straight N drawn in every direction from the geometrical center point CP of the unsupported portion 5 to the edge of the unsupported portion.

As the unsupported portion 5 is provided with the thick part 5*a*, the durability of the face plate 2 may be increased. vibration of the face plate 2 which generates ear-piercing discomfort metallic clank after hitting a ball may be controlled. Further, by providing the thick part 5*a* as in this embodiment, the user can get a stable response when hitting a ball and hitting feel may be further improved.

In order to effectively derive such advantageous results, the area ratio of the thick part 5*a* to the unsupported portion 5 is preferably set in a range of from 30 to 90%, more preferably 40 to 80%, still more preferably 40 to 60%. Here, the area means the projected area on a flat plane substantially parallel to the front surface.

Further, if the ratio (t2/t1) of the thickness t1 of the periphery part 2*b* to the thickness t2 of the thick part 5*a* is more than 2.0, the rebound performance of the clubhead is liable to decrease. If the ratio (t2/t1) is too small, the durability is liable to decrease. Therefore, the ratio (t2/t1) is preferably set in a range of more than 1.0 but not more than 2.0, preferably not less than 1.1 but not more than 1.7, more preferably from 1.2 to 1.5.

Figure 5A:
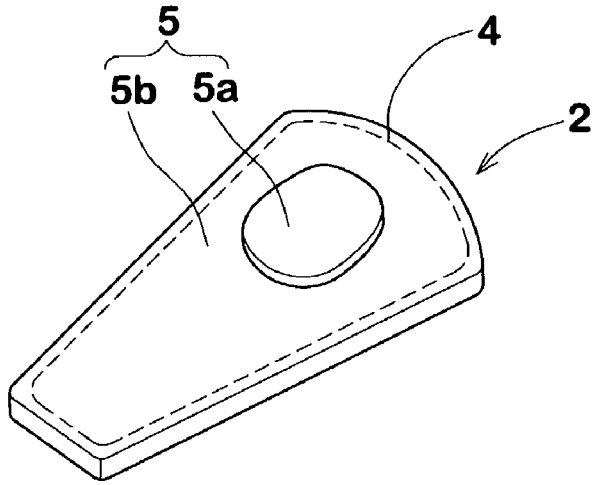
FIGS. 5*a* and 5*b* schematically show examples of the thick part of the face plate.
Figure 5B:
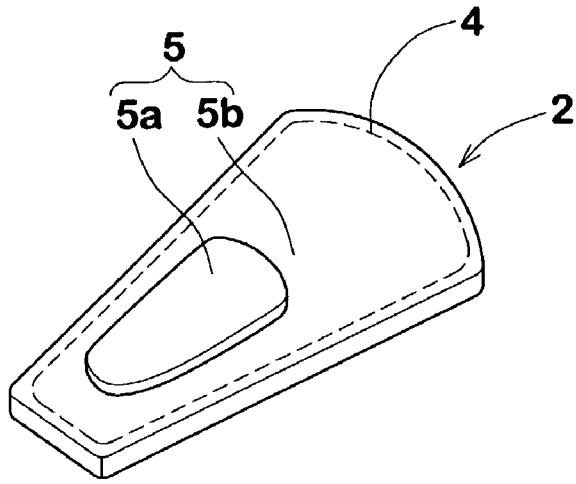

FIGS. 5*a* and 5*b* each shows a modification of the above-mentioned thick part 5*a*. In FIG. 5*a*, the thick part 5*a* is shorter and round and disposed on the toe-side. In FIG. 5*b*, the thick part 5*a* is shorter and disposed on the heel-side. These examples also have the thinner part 5*b* between the thick part 5*a* and periphery part 2*b*.

With respect to the effect on the rigidity of the unsupported portion 5, the thinner part 5*b* has a decreasing tendency and the thick part 5*a* has an increasing tendency. Thus, these are balanced with each other. Therefore, by providing such a thinner part 5*b*, the rigidity of the unsupported portion 5 is moderated and advantageous flexural deformation can be obtained. As a result, the face plate 2 may be improved in the flexural performance, wile maintaining the durability.

In order to prevent deterioration of the durability of the unsupported portion 5, the thickness t3 of the thin part 5*b* is preferably set in a range of from 80 to 100% of the thickness t1 of the periphery part 2*b*.

In this example, the thickness Tt(T) of the back-support wall 4*b* in the upper rim portion 3*a* which supports the upper part of the face plate 2 is set to be less than the thickness t1 of the periphery part 2*b* of the face plate 2.

In the conventional iron-type golf clubheads, the thickness Tt of the back-support wall 4*b* is conventionally set in a range of more than the thickness t1 of the periphery part 2*b* of the face plate 2 and therefore, much weight is distributed in this part. However, as a result of inventor's researches, it was found that actual hitting points concentrate on a lower portion of the clubface F rather than the center portion. Therefore, in the present invention, the thickness Tt in the upper rim portion 3*a* which may have no substantial effect on the durability is set to be less than the thickness t1 so as to be able to reduce the weight in the upper part of the clubhead. The reduced weight can be used for another part, e.g. the sole portion and/or back face portion of the main body 3 in order to make the gravity point lower and/or deeper. Thus, the design freedom of the gravity point is increased.

The thickness Tt of the back-support wall 4*b* in the upper rim portion 3*a* is preferably set in a range of from 50 to 95%, more preferably 50 to 80%, still more preferably 50 to 70% of the thickness t1 of the periphery part 2*b* of the face plate 2. If the thickness Tt is less than 50%, the durability becomes insufficient.

Figure 6:
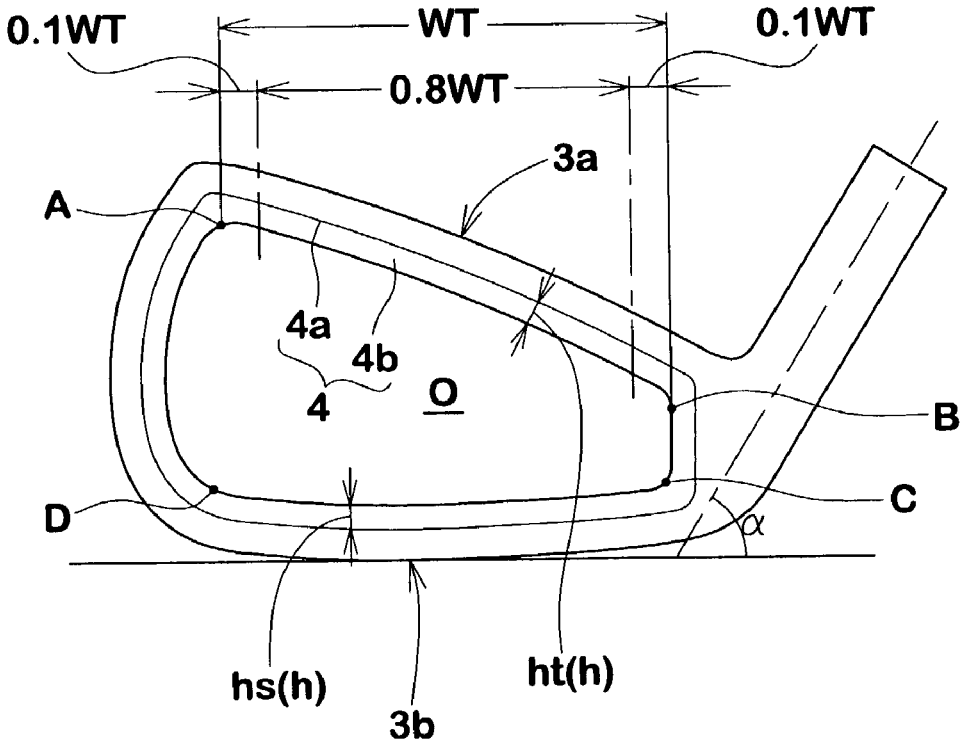
FIG. 6 is a front view of the main body of the clubhead.

Such thin back-support wall 4*b* in the upper rim portion 3*a* is, as shown in FIG. 6, preferably formed through a 80% range of a length WT, excluding both end parts of 10% of the length WT, wherein the length WT is defined in the horizontal direction as being between a first point (A) which is the extremity on the toe side (in the FIG. 6 example the uppermost point) of the inner circumferential edge of the back-support wall 4*b* and a second point (B) which is the extremity on the heel side, of the inner circumferential edge of the back-support wall 4*b*.

In the upper rim portion 3*a*, the height ht(h) of the back-support wall 4*b* is preferably set in a range of from 2.0 to 5.0 mm, more preferably 2.5 to 3.5 mm.

If the height ht is less than 2.0 mm, the holding of the face plate 2 becomes insufficient, and the durability tends to decrease. If the height ht is more than 5.0 mm, even though the thickness Tt of the back-support wall 4*b* is limited as above, there is a possibility of the weight being concentrated on the clubhead upper part, and it becomes difficult to lower the gravity point. Through the above-mentioned height ht, the thickness Tt is less than the thickness t1.

The thickness H1 of the circumferential wall 4*a* in the upper rim portion 3*a*, which is the distance from the surface of the circumferential wall 4*a* to the top surface or outer circumferential surface of the upper rim portion 3*a*, is preferably set in a range of from 2.5 to 5.5 mm, more preferably 3.0 to 4.5 mm. It is preferable that the thickness H1 satisfies this limitation through the above-mentioned 80% range of the length WT. By limiting the thickness H1 in this way, it becomes possible to more effectively reduce the weight of the upper rim portion 3*a*.

FIGS. 7–12 each show another embodiment of the present invention. In order to avoid redundancies, points different from the former embodiments will be descried. As to the numerical limitations in particular, the descriptions made in the former embodiments may be applied here. Reference should be made.

Figure 7:
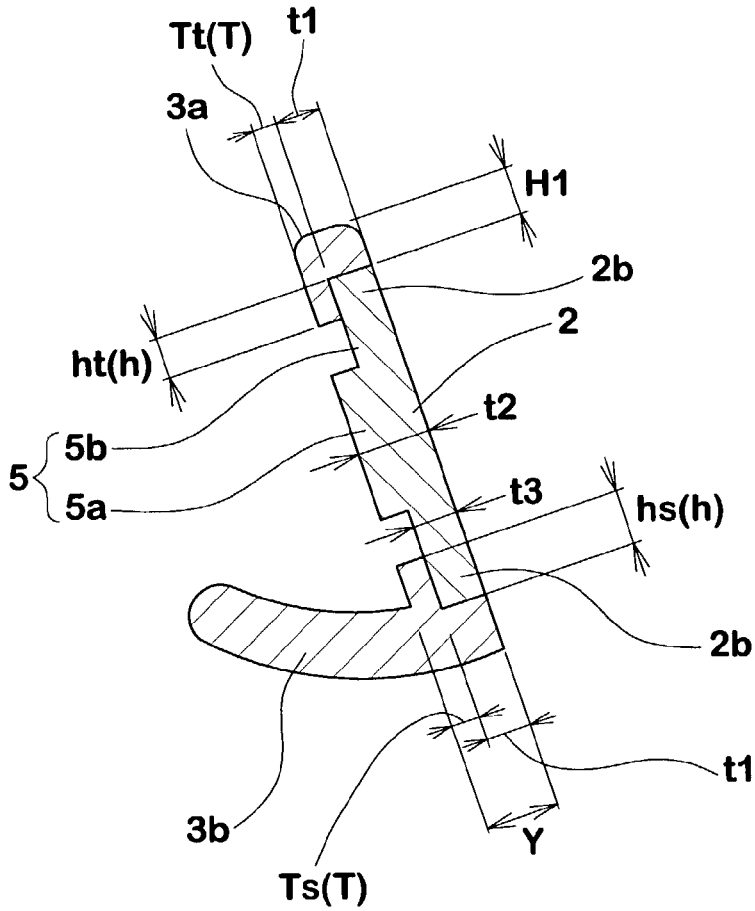
FIGS. 7, 8, 9, 10, 11 and 12 are cross sectional views each showing another embodiment of the present invention.

In FIG. 7, in addition to the back-support wall 4*b* in the upper rim portion 3*a* as explained above, the thickness ts(t) of the back-support wall 4*b* in the lower rim portion 3*b* is less than the thickness t1 of the periphery part 2*b* of the face plate 2 through its entire height hs. Preferably, such thin back-support wall 4*b* in the lower rim portion 3*b* is, similarly to the upper rim portion 3*a*, formed through a 80% length range of a horizontal length between the extremity (D) on the toe side and the extremity (C) on the heel side, of the inner circumferential edge of the back-support wall 4*b*. The reduced weight is utilized to enlarge the above-mentioned backward extension forming the sole.

The total thickness Y of the thickness ts and the thickness t1 is set to be smaller than the conventional clubheads, specifically, set in a range of from 3.0 to 8.0 mm, preferably 3.0 to 6.0 mm, more preferably 4.0 to 6.0 mm.

If the total thickness Y is less than 3.0 mm, by the shock when hitting a ball, the durability is liable to decrease in the face mount 4 in the lower rim portion 3*b* and the like. If the total thickness Y is more than 8.0 mm, the effect of the weight reduction in the vicinity of the face mount 4 becomes decreased.

In order to effectively reduce the weight while maintaining the durability of the face mount 4 in the lower rim portion 3*b*, the ratio (t1/Y)of the total thickness Y and the thickness t1 is preferably set in a range of more than 0.5 but not more than 0.8, more preferably from 0.6 to 0.7.

If the ratio (t1/Y)is more than 0.8, the thickness ts becomes too small and the durability is liable to decrease in the lower rim portion. If the ratio (t1/Y)is less than 0.5, the effect of the weight reduction on the face mount 4 becomes decreased.

The height hs of the back-support wall 4*b* which is thinner than the periphery part 2*b* in the lower rim portion 3*b* is preferably set in a range of from 2.0 to 5.0 mm, more preferably 2.5 to 3.5 mm. If the height hs is less than 2.0 mm, holding of the face plate 2 becomes insufficient and the durability is liable to deteriorate. If the height hs is more than 5.0 mm, even though the thickness TS of the back-support wall 4*b* is limited as above, there is a possibility of the weight being concentrated on the front side of the clubhead, and it becomes difficult to make the gravity point deeper.

In the first two embodiments, the thickness-reduced back-support wall 4*b* is formed in the upper rim portion 3*a* and lower rim portion 3*b*. However, in addition to these portions 3*a* and 3*b*, the thickness-reduced back-support wall 4*b* can be formed in the toe-side rim portion 3*c* and/or heel-side rim portion 3*d*.

Figure 8:
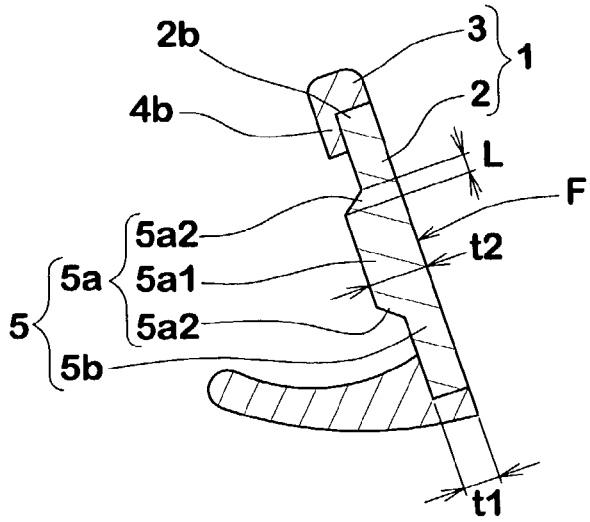
Figure 9:
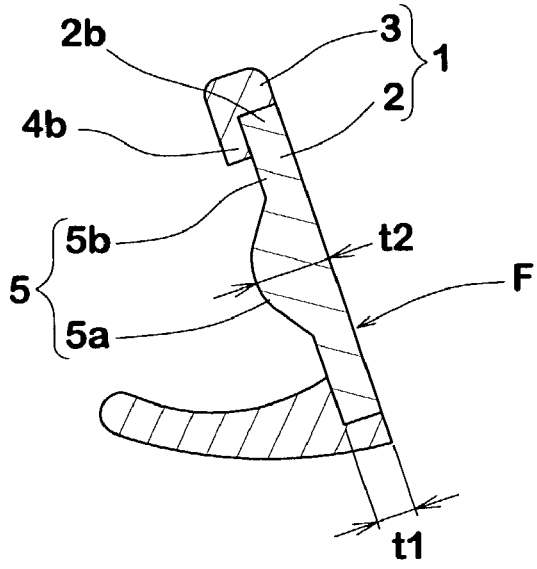

FIG. 8 and FIG. 9 show other examples of the face plate 2, wherein the thickness t2 of the thick part 5*a* varies contrary to the former two embodiments.

In FIG. 8, the thick part 5*a* is composed of a main portion 5*a*1 having a constant largest thickness t2 and a taper portion 5*a*2 surrounding the main portion 5*a*1 and having a thickness continuously decreasing outwards towards the thin part 5*b* at a substantially constant rate.

In FIG. 9, the thickness of the thick part 5*a* continuously varies over its entirety. More specifically, the thickness continuously decreases from the central thickest part (t2) towards the thin part 5*b*, wherein the decreasing is not a constant rate. Thus, the rigidity change in the unsupported portion 5 due to the thickness change becomes smooth, and the stress is dispersed and the durability may be improved.

Figure 10:
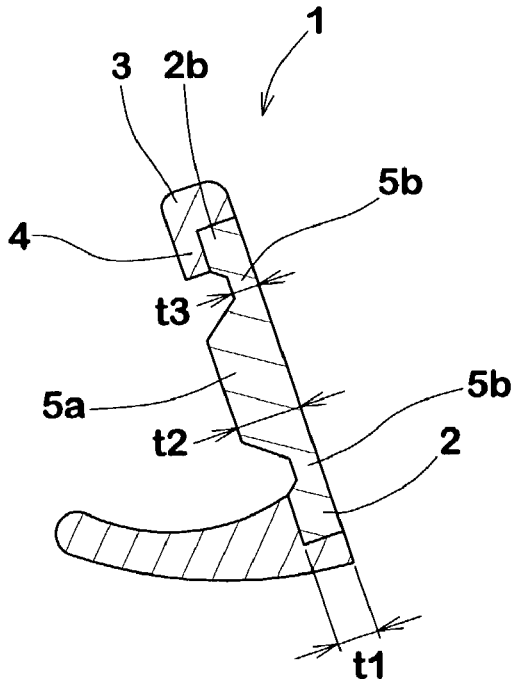

In FIG. 10, the unsupported portion 5 is a modification of the FIG. 8 example. The unsupported portion 5 is provided between the thick part 5*a* (=5*a*1+5*a*2) and the periphery part 2*b* with a middle part 5*b* being thinner than the supported periphery part 2*b*. The thinner middle part 5*b* in this example is annular and continuous around the thick part 5*a*.

The minimum thickness t3 of the middle part 5*b* is set in a range of not less than 0.5 times but less than 1.0 times, preferably not less than 0.7 times but less than 1.0 times, more preferably not less than 0.8 times but less than 1.0 times the thickness t1 of the periphery part 2*b*.

In this example, as the thinner middle part 5*b* is formed around the thick part 5*a* where the shock due to hitting a ball is relatively small, the thickness can be minimized which makes it possible to increase the elastic deformation of the face plate 2 when hitting a ball and the rebound performance of the clubhead may be further improved.

Figure 11:
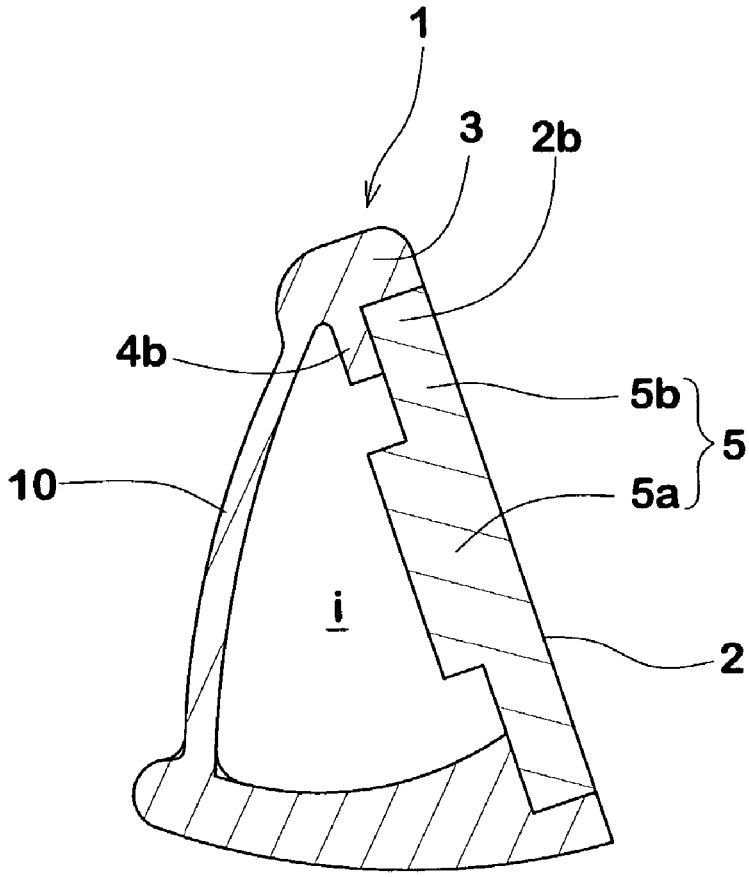

In FIG. 11, the main body 3 further comprises a rear wall 10 away from the back surface of the unsupported portion 5 and fully covering the back of the unsupported portion 5. Because of the rear wall 10, the gravity point of the clubhead becomes deeper and the sweet spot area becomes broader. Further, a hollow (i) or cavity which is formed behind the face plate 2 can be utilized to improving the ball-hitting sound by filling the hollow (i) with foamed resin for example.

Figure 12:
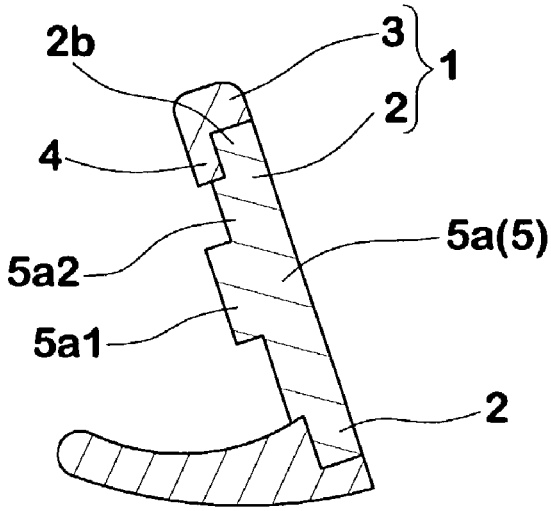

In FIG. 12, the unsupported portion 5 is the thick part 5*a*. In other words, the entirety of the unsupported portion 5 is thicker than the supported periphery part 2*b*.

The thick part 5*a* in this example consists of a central thickest part 5*a*1 and a surrounding outer part 5*a*2.

As the face mount 4 is constructed as above, it becomes possible to set the depth of the gravity point in a preferred range of not less than 4.0 mm. Thus, the depth is set in this range, more preferably set in a range of 4.5 to 7.0 mm. Incidentally, the depth of the gravity point means the minimum distance from the gravity point to the clubface F. Further, the height of the gravity point of the clubhead is preferably set in a range of not more than 21 mm, more preferably in a range of from 19 to 21 mm.

Comparison Tests

Iron-type golf clubheads for #5 iron were experimentally made, wherein the main body was a casting of sus630 and the face plate was a casting of Ti-6Al-4V. These clubheads were attached to identical shafts, and #5 iron clubs were made. The position of the gravity point of the clubhead was obtained. The moment of inertia around the gravity point was measured. These iron clubs were tested for the durability, rebound performance and carry as follow.

Durability Test

The iron club was attached to a swing robot and hit golf balls 3000 times by the central part of the clubface at a head speed of 40 m/s. Then, the face plate was visually checked.

Rebound Performance Test

According to the "Procedure for Measuring the Velocity Ratio of a Club Head for Conformance to Rule 4-1e, Appendix II, Revision 2 (Feb. 8, 1999), United States Golf Association", the restitution coefficient (e) of each club head was obtained. The results are shown in Table 1.

Carry Test

The iron club was attached to a swing robot and hit golf balls by the center of the clubface at a head speed of 34 m/s, and the carry was measure.

Test results and the specifications of the clubheads are shown in Table 1.

TABLE 1

Figure 13:
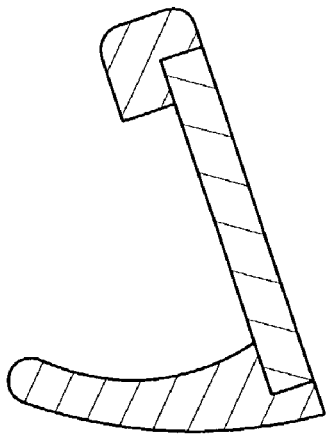
FIG. 13 is a cross sectional view of a clubhead used as a reference in the undermentioned comparison tests.

| Clubhead | | Ex.1 | Ex.2 | Ex.3 | Ex.4 | Ex.5 | Ex.6 | Ref. |
|---|---|---|---|---|---|---|---|---|
| Face plate | | FIG.2 | FIG.2 | FIG.2 | FIG.7 | FIG.7 | FIG.7 | FIG.13 |
| Thickness | | | | | | | | |
| t1 | (mm) | 2.0 | 1.7 | 1.5 | 2.3 | 2.0 | 1.7 | 3.0 |
| t2 | (mm) | 2.5 | 2.5 | 2.5 | 2.5 | 2.5 | 2.5 | 3.0 |
| t3 | (mm) | 2.0 | 1.7 | 1.5 | 2.3 | 2.0 | 1.7 | 3.0 |
| Main body | | | | | | | | |
| Back-support wall | | | | | | | | |
| Upper portion | | | | | | | | |
| Thickness Tt | (mm) | 2.0 | 2.0 | 2.0 | 2.0 | 1.7 | 1.5 | 3.5 |
| Height ht | (mm) | 3.0 | 3.0 | 3.0 | 3.0 | 3.0 | 3.0 | 4.0 |
| Sole portion | | | | | | | | |
| Thickness Ts | (mm) | 2.0 | 2.0 | 2.0 | 2.0 | 1.7 | 1.5 | 3.5 |
| Height hs | (mm) | 5.0 | 5.0 | 5.0 | 3.5 | 3.5 | 3.5 | 6.0 |
| Toe and heel | | | | | | | | |
| Thickness | (mm) | 2.0 | 2.0 | 2.0 | 2.0 | 1.7 | 1.5 | 3.5 |
| Test results | | | | | | | | |
| Gravity point | | | | | | | | |
| Height | (mm) | 21.0 | 20.6 | 20.3 | 21.0 | 20.6 | 20.4 | 21.5 |
| Depth | (mm) | 3.5 | 3.8 | 4.2 | 3.6 | 4.0 | 4.4 | 3.0 |
| Moment of inertia | (g.sq. cm) | 3050 | 3300 | 3500 | 3200 | 3350 | 3700 | 2500 |
| Restitution coefficient | | 0.76 | 0.79 | 0.82 | 0.77 | 0.80 | 0.84 | 0.71 |
| Cary | | 173 | 179 | 182 | 174 | 181 | 184 | 168 |
| Durability*1 | | NP | NP | NP | NP | NP | NP | NP |

*1) NP=nothing peculiar

What is claimed is:

1. An iron-type golf clubhead comprising a face plate having a front surface forming a clubface, a back surface and a circumferential surface, and a main body provided with a face mount in which the face plate is fitted, the face mount comprising a side wall for supporting said circumferential surface and a back-support wall for supporting a periphery part of said back surface, whereby said face plate is provided with an unsupported part, said back-support wall comprising a part whose thickness (T, Tt, Ts) is less than a thickness (t1) of said periphery part supported by the back-support wall, wherein the thickness (t1) is in a range of from 1.5 to 2.5 mm, and the thickness (T) is in a range of from 50 to 95% of the thickness (t1), and wherein said face plate comprises a thick central part and a thinner part, the thinner part formed between the thick central part and said periphery part so that the thick central part is surrounded by the thinner part.

2. An iron-type golf clubhead according to claim 1, wherein said part whose thickness (T) is less than the thickness (t1) has a height in a range of from 2.0 to 5.0 mm.

3. An iron-type golf clubhead according to claim 2, wherein said part of the back-support wall whose thickness (Tt) is less than the thickness (t1) of the periphery part supported by the back-support wall, is an upper part of the back-support wall which part supports an upper periphery part of the back surface.

4. An iron-type golf clubhead according to claim 2, wherein said part of the back-support wall whose thickness (Tt) is less than the thickness (t1) of the periphery part supported by the back-support wall, is an upper part of the back-support wall which part supports an upper periphery part of the back surface, and an upper part of said side wall which part supports an upper part of said circumferential surface has a thickness (H1) in a range of from 2.5 to 5.5 mm.

5. An iron-type golf clubhead according to claim 2, wherein said part of the back-support wall whose thickness (Ts) is less than the thickness (t1) of the periphery part supported by the back-support wall, is a lower part of the back-support wall which part supports a lower periphery part of the back surface.

6. An iron-type golf clubhead according to claim 1, wherein said part of the back-support wall whose thickness (Tt) is less than the thickness (t1) of the periphery part supported by the back-support wall, is an upper part of the back-support wall which part supports an upper periphery part of the back surface.

7. An iron-type golf clubhead according to claim 1, wherein said part of the back-support wall whose thickness (Tt) is less than the thickness (t1) of the periphery part supported by the back-support wall, is an upper part of the back-support wall which part supports an upper periphery part of the back surface, and an upper part of said side wall which part supports an upper part of said circumferential surface has a thickness (H1) in a range of from 2.5 to 5.5 mm.

8. An iron-type golf clubhead according to claim 1, wherein said part of the back-support wall whose thickness (Tt) is less than the thickness (t1) of the periphery part supported by the back-support wall, is a lower part of the back-support wall which part supports a lower periphery part of the back surface.

9. An iron-type golf clubhead according to claim 8 or 5, wherein the total thickness (Y) of the thickness (Ts) of the back-support wall in a lower portion and a thickness (t1) of the periphery part supported by the back-support wall is in a ranage of from 3.0 to 8.0 mm, and the ratio (t1/Y) of the thickness (t1) to the total thickness Y is in a range of more than 0.5 but not more than 0.8.

10. An iron-type golf clubhead according to claim 1, wherein the main body is made of a material having a specific gravity larger than that of the face plate.

11. An iron-type golf clubhead according to claim 1 or 10, wherein the thickness of the thick central part is in a range of from 2.0 to 6.0 mm.

12. An iron-type golf clubhead according to claim 1 or 10, wherein the thickness of the thinner part is in a range of from 80 to 100% of the thickness of the periphery part.

13. An iron-type golf clubhead according to claim 1 or 10, wherein the area of the thick central part is in a range of from 30 to 90% of the overall area of the unsupported portion.

14. An iron-type golf clubhead according to claim 1 or 10, wherein the ratio (t2/t1) of the thickness (t2) of the thick central part to the thickness (t1) of the periphery part is more than 1.0 but not more than 2.0.

* * * * *